United States Patent [19]

Lolly

[11] Patent Number: 4,549,868

[45] Date of Patent: Oct. 29, 1985

[54] JET PROPULSION SYSTEM FOR BOATS

[76] Inventor: Richard W. Lolly, P.O. Box 33, Lolly Rd., Bokeelia, Fla. 33922

[21] Appl. No.: 631,441

[22] Filed: Jul. 16, 1984

[51] Int. Cl.[4] ..... B63H 11/00

[52] U.S. Cl. ..... 440/42; 440/46; 440/38

[58] Field of Search ..... 440/38, 40, 42, 46; 114/255, 343

[56] References Cited

U.S. PATENT DOCUMENTS

| | | | |
|---|---|---|---|
| 1,237,674 | 8/1917 | Moiseeff | 440/42 |
| 3,046,735 | 7/1962 | Burgin | 440/42 |
| 3,142,285 | 7/1964 | Sorrentino | 440/42 |
| 4,033,280 | 7/1977 | Wood | 114/343 |
| 4,056,073 | 11/1977 | Dashew | 440/42 |
| 4,157,074 | 6/1979 | Sherwood | 440/42 |

*Primary Examiner*—Trygve M. Blix
*Assistant Examiner*—C. T. Bartz
*Attorney, Agent, or Firm*—Alfred E. Wilson

[57] ABSTRACT

A jet actuated boat propulsion device is provided for driving a boat in areas where hyacinths or other water vegetation exists, and which normally would foul up the operation of an outboard or inboard motor. A water pump positioned in a well in the bottom of the boat and communicating with the water in which the boat is floating is connected through conduits to discharge a jet of water through a nozzle extending into the body of water in which the boat is floating. The jettisoned water being discharged into the body of water exerts a jet action or thrust which drives the boat through the water. The difficulties which have heretofore been encountered in propelling boats in areas where hyacinths or other water plants exist have thus been virtually eliminated because the discharge pipe for the water being jettisoned projects into the body of water at an angle, and therefore the hyacinths and other water plants slip off of the pipe for the jettisoned water and exerts a forward thrust on the boat from an area beneath the surface of the body of water in which the boat is floating. A modified form includes a motor driven pump connected to twin pipes, one of which is a water inlet and the other pipe is the jet pipe to drive the boat through the water.

1 Claim, 5 Drawing Figures

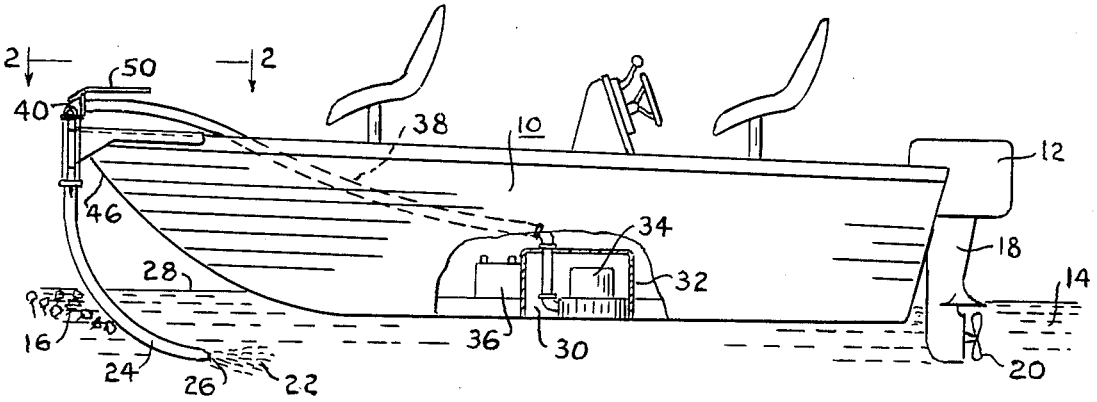
Fig.-1
Fig.-2
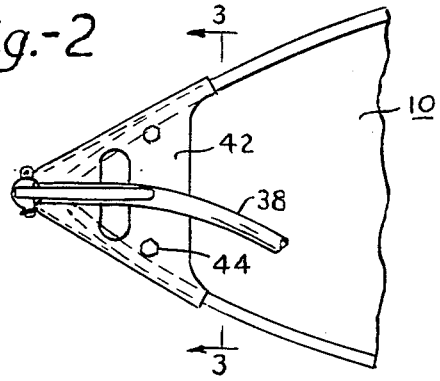
Fig.-3
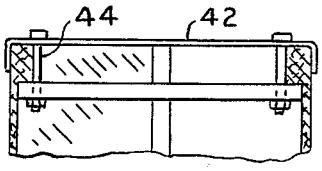
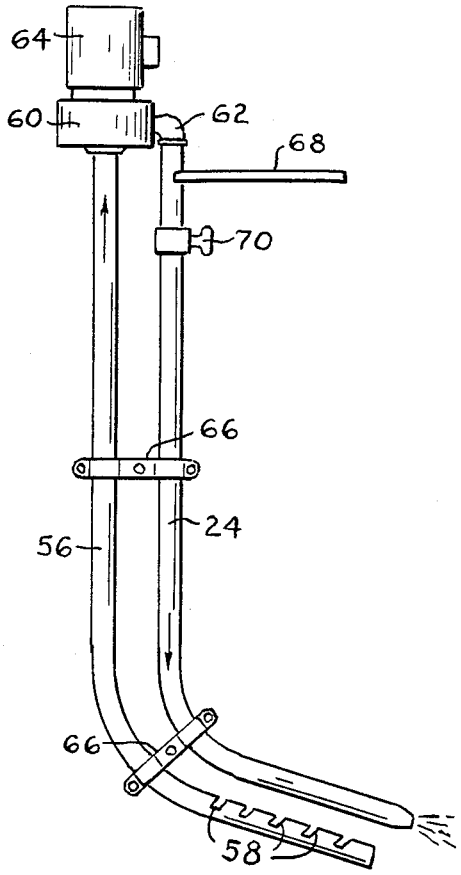
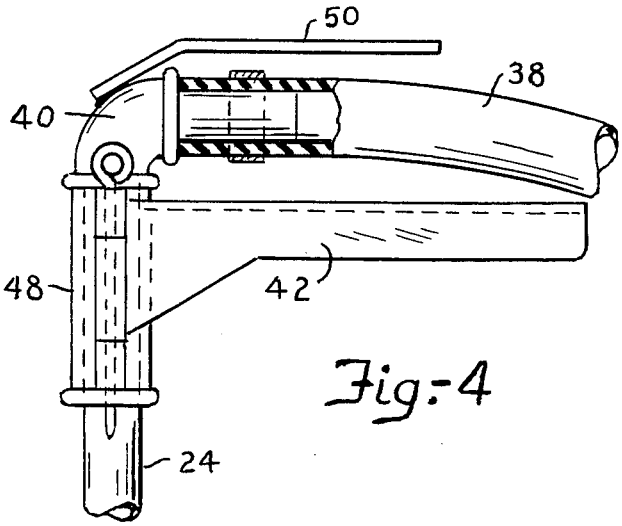
Fig.-4
Fig.-5

JET PROPULSION SYSTEM FOR BOATS

BACKGROUND OF THE INVENTION

Heretofore great difficulties have been experienced in attempting to propel boats with outboard motors in areas where hyacinths or other water plants exist. The great majority of the light weight or small boats used for fishing and for pleasure are equipped with outboard motors because such equipment is lighter and cheaper than are boats with inboard motors. In instances where hyacinths or other water plants exist the hyacinths are caught by the downwardly extending housing of the outboard motor and build up around it and very quickly build up to such an extent that it is necessary to lift the outboard motor out of the water to remove the hyacinths or other water plants. This process of lifting the outboard motor out of the water to clean it of the water plants is repeated frequently.

FIELD OF THE INVENTION

The broad field of this invention relates to the possibility of propelling a small boat of the outboard motor class through water having hyacinths or other water growth plants which interfere with the propelling of such boats.

I have found that such boats can advantageously be propelled through water infested with hyacinths or other water plants by subjecting the water beneath the hyacinths or other water plants to a jet of water to exert pressure in the water to drive the boat to ride through the water plants without becoming clogged thereby. The jet pipe through which the pressurized water is discharged is preferably positioned at an angle to the vertical so as to ride over the water plants without pushing them ahead of it.

DESCRIPTION OF THE PRIOR ART

The major prior art deals with the provision of weed eliminating devices to protect the propellers and drive housings of outboard motors. These devices attempt to protect the units from hyacinths and other water plants by providing guards in an effort to catch the water plants and prevent them from clinging to the drive housing units and propellers of outboard motors. Major efforts have been made to shaping the units so that water plants will glide off and be deflected away from the drive housings and propellers.

SUMMARY OF THE INVENTION

This invention is directed to the provision of a water pump powered jet stream adapted to be projected into the body of water in which the boar is floating to exert a jet force in the body of water beneath floating hyacinths or other water plants to guide a boat through areas infested with floating water plants.

The water pump may be located in a boat well positioned anywhere in the boat to permit the pump to receive water from the body of water in which the boat is floating and to direct a stream of pressurized water to propel the boat.

If desired an auxiliary jet powered assembly can be provided having separate water inlet and discharge pipes which can readily be attached to a boat to provide a water plant protected boat driving system for use in areas where an infestation of water plants such as hyacinths exists.

BRIEF DESCRIPTION OF THE DRAWINGS

In the drawings wherein similar reference characters refer to similar parts throughout the several views:

FIG. 1 is a side elevational view, partly in section of a boat equipped with my improved jet propulsion system.

FIG. 2 is a fragmentary plan view of the bow of a boat embodying the jet propulsion system.

FIG. 3 is a sectional view taken substantially on the line 3—3 of FIG. 2, looking in the direction of the arrows.

FIG. 4 is a schematic view illustrating the connection of the jet unit to the boat.

FIG. 5 is a schematic view illustrating the operation of a modified form of the invention.

DESCRIPTION OF THE PREFERRED EMBODIMENT

Referring now to the drawings a boat 10 proportioned to be driven by an outboard motor 12 is floating on a body of water 14. In instances where an accumulation of hyacinths or other water plants 16 abound, the outboard motor 12 frequently becoms jammed up because the water plants contact and wrap around the drive housing 18 of the outboard motor and also foul the propeller 20 as the boat 10 is propelled through the water by the outboard motor 12.

To overcome these problems I have found that in areas where water plants abound, the boat may advantageously be propelled by discharging pressurized water 22 through a jet tube 24, the discharge 26 of which is well beneath the surface 28 of the body of water 14.

May small fishing boats are equipped with fish holding wells 30 having side walls 32 extending above the surface 28 of the body of water 14. An electrically driven water pump 34 adapted to be powered by a battery 36 is positioned in the fish holding well 30 to deliver pressurized water through a conduit 38 to a connector 40 secured in a triangular support 42 secured by clamp bolts 44 to the bow 46 of the boat 10. The jet tube 24 is journalled in a fitting 48, and may be rotated therein by a steering handle 50 by which the angularity of the discharge 26 may be oscillated to steer the boat 10.

The operation is as follows: When hyacinths or other water plants are encountered in sufficient quantity to foul the outboard motor 12 the motor can be oscillated to the inoperative position where the drive housing 18 is elevated to a horizontal position with the propeller 20 out of the water 14. The electrically driven water pump 34 is then turned on to pressurize water from the fish holding well 30 and transmit it through the conduit 38, connector 40 to the jet tube 24. The steering handle 50 is then manipulated to direct the discharge 26 of the jet tube 24 to discharge pressurized water 22 to drive the boat 10 in the direction in which it is desired to travel.

The jet tube 24 is positioned at an angle to the surface 28 of the body of water 14 to strike the hyacinths or other water plants 16 at an angle to cause them to slide off of the jet tube 24 whereupon the jet tube rides over the hyacinths and does not become blocked by them. The pressurized water 22 emitted by the discharge 26 from the jet tube 24 exerts sufficient thrust in the water to drive the boat 10 at whatever speed is desired, it being understood that the speed at which the boat is driven can be increased by increasing the pressure of the water discharged from the jet tube 24. Also it will be understood that the boat 10 can readily be steered by manipulating the steering handle 50 to direct the jet tube 24 to discharge pressurized water to drive the boat in the direction in which it is desired to travel.

The operation of the embodiment illustrated in FIG. 5 is similar to that illustrated in FIGS. 1 to 4 except that an auxiliary water inlet tube 56 has rearwardly facing water inlet passages 58 adapted to be submerged in the body of water 14 so as to admit water into the tube 56 without becoming clogged with hyacinths or other water plants.

A water pump 60 is positioned at the top of the water inlet tube 56 to receive water from the tube 56 and pressurize it and discharge it to the jet pipe 24 through the fitting 62. The pump 60 can be driven by a motor 64 which can be of the electric or gasoline type where the battery or fuel tank would be in the boat 10.

The water inlet and outlet tubes 56 and 24 are connected together by brackets 66, and the assembly may be pivotally mounted on the boat 10 about the jet tube 24 and may be oscillated by the handle 68 about the jet tube 24 to steer the boat. The assembly can be elevated or lowered with respect to the surface of the water by loosening the bracket 70 and moving the assembly to the position desired, then tightening the bracket to hold the assembly in the desired adjusted position.

I claim:

1. A jet propulsion drive system for a boat floating in a body of wate that may be infested with hyacinths or other water plants, the boat having a bow, parallel water inlet and discharge pipes mounted on the bow of the boat, manually operable adjustable means to clamp the water inlet and discharge pipes at selected vertical elevations relative to the bow of the boat, a motor driven pump mounted on the inlet and discharge pipes, the water inlet pipe having rearwardly facing water inlet passages to be submered in the water to admit water into the inlet pipe without becoming clogged with hyacinths or other water plants, the water discharge pipe having an angularly inclined discharge opening to discharge water at an angle relative to the bow of the boat, and a manually operable lever to oscillate the water inlet and discharge pipes about a vertical axis to exert a thrust in the water to steer the boat.

* * * * *